US006409152B1

(12) United States Patent
Bagley

(10) Patent No.: US 6,409,152 B1
(45) Date of Patent: Jun. 25, 2002

(54) METHOD AND APPARATUS FOR A TACK TOOL

(76) Inventor: Jim M. Bagley, 801 W. Layton Ave. (1805 S.), Salt Lake City, UT (US) 84104

( * ) Notice: Subject to any disclaimer, the term of this patent is extended or adjusted under 35 U.S.C. 154(b) by 0 days.

(21) Appl. No.: 09/615,136

(22) Filed: Jul. 13, 2000

(51) Int. Cl.[7] ..... B25C 11/00

(52) U.S. Cl. ..... 254/18; 254/25; 254/28; 81/44; 7/166

(58) Field of Search ..... 254/18, 25, 28, 254/17; 81/44; 7/166

(56) References Cited

U.S. PATENT DOCUMENTS

| | | | | | |
|---|---|---|---|---|---|
| 549,895 | A | * | 11/1895 | Browne | 254/18 |
| 584,189 | A | * | 6/1897 | Nelson | 254/18 |
| 608,555 | A | | 8/1898 | Nazel | |
| 742,284 | A | * | 10/1903 | Browne | 254/18 |
| 960,193 | A | * | 5/1910 | Peterson | 254/18 |
| 1,043,369 | A | * | 11/1912 | Smith | 254/18 |
| 1,101,845 | A | * | 6/1914 | Graue | 254/18 |
| 1,141,741 | A | * | 6/1915 | Wiseman | 254/18 |
| 1,369,420 | A | | 2/1921 | Gllespie | |
| 2,094,459 | A | | 9/1937 | Lipsom | |
| 2,533,112 | A | | 12/1950 | Hayden | |
| 2,690,501 | A | | 10/1954 | Scheurmann | |
| 2,753,150 | A | | 7/1956 | Gibson | |
| 2,780,811 | A | | 2/1957 | Rodin | |
| 3,009,155 | A | | 11/1961 | Leniz | |
| 3,218,030 | A | | 11/1965 | Baro | |
| 3,250,308 | A | | 5/1966 | March | |
| 3,549,075 | A | | 12/1970 | Tsunemi | |
| 3,899,157 | A | | 8/1975 | Thomas | |
| 4,553,737 | A | * | 11/1985 | Yi | 254/18 |
| 4,881,676 | A | | 11/1989 | Peter | |

* cited by examiner

*Primary Examiner*—Joseph J. Hail, III
*Assistant Examiner*—Lee Wilson
(74) *Attorney, Agent, or Firm*—Morriss, Bateman, O'Bryan & Compagni

(57) ABSTRACT

A tack tool apparatus and a method of use comprises a user operable, hand gripable, and storable apparatus for removing, inserting, and straightening a tack. The tack tool is an elongated member with one end formed into a first cylindrical member. The other end is formed into a forked wedge member. The forked wedge member is angularly displaced relative to the longitudinal length of the elongated member. The first cylindrical member has one end closed forming a convex portion. The first cylindrical member has an inner surface disposed about a coaxially positioned second cylindrical member. The second cylindrical member has a metallic retaining mechanism mounted within for positioning tacks during insertion. A method of using the tack tool to remove a tack from adjoined surfaces comprises a user grasping the elongated member with either hand, and positioning the forked wedge member's bottom surface onto the surface of the structure of the structure containing the tack. The tack tool engages the tack head causing the tack head to move upwardly along the top surface of the forked wedge member thereby extracting the tack from the two adjoined structures.

10 Claims, 2 Drawing Sheets

METHOD AND APPARATUS FOR A TACK TOOL

BACKGROUND OF THE INVENTION

Tacks are produced in various sizes and shapes. Some have a rather short cylindrical body or stem with a point on one end of the stem. The other end of the stem usually has some type of head to assist a user in inserting the tack. The head portion may, if desired, be a pan-head, flat head, or mushroom-head. When inserting the tack into any type of material, axial pressure is exerted on the stem of the tack via the head portion. When sufficient pressure is applied to the head portion, the tack becomes inserted into the desired material thereby connecting the material to a desired structure. If this procedure is done correctly, the tack is inserted linearly i.e., the tack head does not rotate or bend along the body of the stem. When the procedure is done incorrectly, the head portion becomes bent, twisted, or rotated along the stem of the tack. Tacks with bent or malformed heads are usually discarded or attempts are made to straighten the head portion in relation to the stem portion. This procedure usually results in the tack head separating from the stem.

A tack may, if desired, be used to retain various types of material to a structure. Examples of materials are paper, cloth, matted paper, polymer composition, vinyl, cloth, quilted cloth, and the like. Structures may, if desired, be the same or different composition as the materials. An example is a cardboard structure retaining paper material. Tacks, once inserted into the structure, become affixed to the structure and are difficult to remove. Removing a tack fastened material from a structure with a tack extraction tool may be difficult because the head portion of the tack represents a low profile to the extraction tool.

The dynamics of successfully inserting a tack into various types of material and structure are complex. If this were not the case, tacks would always be inserted into material and structure perfectly every time. The physical size of tacks generally does not lend itself to hand insertion. Many tools have been developed to compensate or change the way tacks are inserted and removed. One attempt at developing a tool to insert tacks is disclosed in U.S. Pat. No. 2,753,150 issued to Gibson on Oct. 21,1953. The Gibson patent discloses, in part, a thumb tack tool that has an embedded magnet just beneath the surface on one end of the tool. The magnet provides a retaining mechanism to presumably hold the tack in an upright position while being inserted into the material and structure by a user. The body of the tool is substantially rectangular with two corners of the rectangle rounded to some degree. The structure of the tool may lend itself to residing in an upright storage position but once gripped by the user between the thumb and forefinger the body of the tool loses its ergonomic function.

The Gibson patent also discloses the tool having a claw shaped footed portion to assist in the removal of a tack that has been inserted into the material and structure. The claw foot resembles a beveled wedge much like the blade portion of a screwdriver. The claw foot is inserted under the tack and with lever action the body of the tool is rotated about a fulcrum point; thereby force is applied to the head portion of the tack dislodging it from its associated structure. The lever action by the Gibson tool requires adequate space to maneuver and rotate the tool to provide the required force to dislodge and remove the tack.

Another attempt to provide a user with a tack inserting and removal tool is U.S. Pat. No. 3,218,030 issued to Baro on Nov. 16, 1965. The Baro patent discloses an elongated cylinder with a magnet inserted into a recessed area on one end of the cylinder. The tack head is placed in the recessed area and then inserted into the material and structure. The insertion method of the Baro patent suffers from the same ergonomic deficiencies as the Gibson patent. The Baro tool is grasped between the thumb and forefinger and pressure is applied via the intersection of the thumb and forefinger. The thumb and forefinger only facilitate the gripping of the tool and not the insertion of the tack.

The Gibson and Baro patents demonstrate a long felt but unresolved need for a user operable, hand gripable apparatus for inserting, straightening, and removing tacks. It would be desirable to have an apparatus that incorporates ergonomic features enabling the user to insert tacks into material and structure using the maximum required force without damage to the tack, the intended material or the structure. Another desirable ergonomic feature would enable the user to remove the tack from the material or structure through non-lever action thus preserving the material and structure from damage. In the event the tack is damaged due to improper insertion or other reasons, the apparatus would incorporate a tack straightening feature.

SUMMARY OF THE INVENTION

The present invention is a user operable, hand gripable, and storable tool or apparatus that incorporates ergonomic features enabling a user to insert, straighten, or remove tacks using the maximum required force without damage to the tack, the intended material or the structure. The present invention has a forked wedge member, a first cylindrical member, and an elongated member connected there between. The forked wedge member is angularly disposed to the elongated member. The angular relationship between the forked wedge member and the elongated member is such to enable the user to grasp the elongated member while the bottom surface of the forked wedge member is in contact with the surface containing the tack to be extracted. The user slides the present invention forward engaging the tack head with the forked wedge member. The tack stem slides along the V-shaped portion of the forked wedge member and the head of the tack slides upward along the top surface of the forked wedge member thusly extracting the tack.

The first cylindrical member has one end closed forming a convex portion thereto. A second cylindrical member is coaxially connected within the interior of the first cylindrical member. The second cylindrical member has one end extending outward from the first cylindrical member's other end. A metallic retaining mechanism is coaxially connected within the interior of the second cylindrical member. The metallic retaining mechanism is recessed from the end of the second cylindrical member in such a way as to enable the tack head to be focused towards the metallic retaining mechanism. The user positions the present invention near the tack head and the metallic retaining mechanism attracts and retains the tack.

The user grasps the elongated member with the thumb and forefinger of either hand. The remaining fingers wrap around the elongated member pressing the convex portion into the palm. The user has previously engaged a tack to be inserted into a structure. The user positions the present invention containing the tack in relative proximity to the structure and presses downward with the palm portion thereby inserting the tack into the structure.

A third cylindrical member may, if desired, be mounted on the apparatus in any convenient location. The third cylindrical member has an interior surface formed about a cavity or aperture. The aperture is sufficiently sized to receive the stem portion of the tack. Once a tack stem is inserted into the aperture, the head of the tack may be partially rotated thereby aligning the centerline of the tack head with the centerline of the stem. This procedure straightens the tack and makes it usable.

When taken in conjunction with the accompanying drawings and the appended claims, other features and advantages of the present invention become apparent upon reading the following detailed description of embodiments of the invention.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENT OF THE PRESENT INVENTION

Figure 1:
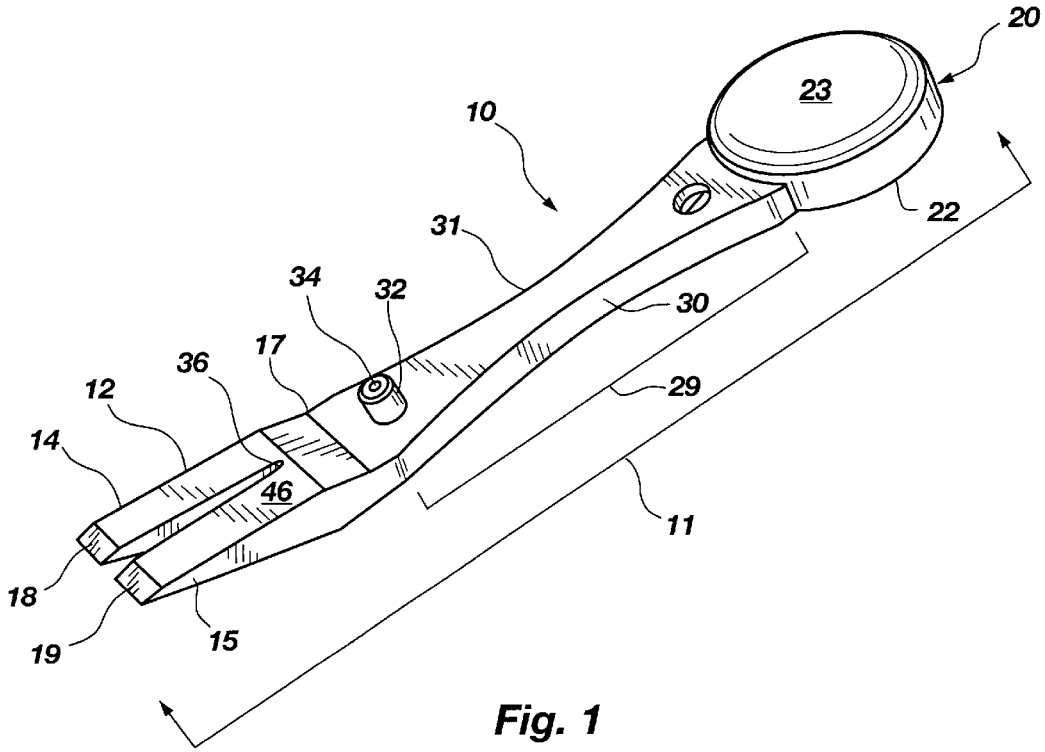
FIG. 1 illustrates a perspective view diagram of the preferred embodiment of the present invention.

The preferred embodiment of the present invention 10, FIG. 1 is a user operable, hand gripable, and storable tool or apparatus for inserting, straightening, and removing a tack (not shown). The present invention 10 may, if desired, be manufactured from any convenient material or process. Examples of convenient materials are plastic, polymer composites, metal, and wood. An example of a manufacturing process for the present invention 10 is injection molding.

The present invention 10 is an elongated member 11 that has one end formed or connected to a forked wedge member 12. The forked wedge member 12 may, if desired, be angularly displaced 25, FIG. 2 from the body portion of the present invention 10. The angular displacement is in the range of about 5° (degrees) to about 45° (degrees). Preferably, the displacement angle is about 15° (degrees). The angular displacement of the forked wedge member 12 relative to the body of the elongated member 11 enables the flat surface 13, FIG. 2 of the forked wedge member 12 to be contiguous with the surface of the intended work surface. For example, the intended work structure may be cloth, quilted fabric, plastic, paper, or cardboard.

The forked wedge member 12, FIG. 1 may, if desired, have at least two prongs 14 and 15. The prongs 14 and 15 form a V-shape 36 adjacent to the base 17 of the elongated member 11. The forked wedge member's 12 top surface 40 is angularly disposed from its bottom surface by about 11.5° (degrees). The tips 18 and 19 of the prongs 14 and 15 may, if desired, be beveled to reduce the initial contact resistance with the tack head. Preferably, the beveled angle is 22.5° (degrees) with respect to the bottom surface 13. The radius of curvature of the beveled tips 18 and 19 are preferably 0.002 inches respectively. The wedge shape of the forked wedge member 12 gradually increases the pressure exerted on contact with the tack head.

A cylindrical member 20 may, if desired, be formed or connected on the other end of the elongated member 11. The cylindrical member 20 is oppositely spaced from the forked wedge member 12. The cylindrical member 20 has an inner surface 21, FIG. 5 and an outer surface 22, FIG. 1. The outer surface 22 is in contact with the elongated member 11. The cylindrical member 20 has one end closed forming a convex shape or portion 23. If desired, a second cylindrical member 24, FIG. 5 may be coaxially formed within the confines of the inner surface 21 of the first cylindrical member 20. The first cylindrical member 20 has a central axis passing through the center of the cylinder and the second cylindrical member 24 has a similar axis passing through its center. When these axes are aligned with each other the cylinders are coaxially aligned. If desired, the second cylindrical member 24 may have a portion thereof extending outward beyond the confines of the first cylindrical member 20. For example, the second cylindrical member 24 extends beyond the confines of the first cylindrical member 20 in the range of 0.1 inch to about ½inch. Preferably, the second cylindrical member 24 extends beyond the confines of the first cylindrical member 20 by 0.125 inches. The interior of the second cylindrical member 24 may, if desired, be recessed 26, FIG. 7 relative to the ending portion of the cylindrical member 24. The recessed portion 26 has a focal point 27 that guides the tack head towards a metallic retaining mechanism 28. The metallic retaining mechanism 28 retains a metallic object such as a tack. An example of a metallic retaining mechanism 28 is a magnet having sufficient gauss to retain the tack.

The medial portion 29, FIG. 1 of the elongated member 11 may, if desired, have curved or concave surfaces 30 and 31. The curved surfaces 30 and 31 enable the user to grasp the medial portion 29 between the thumb and forefinger while the convex surface 23 of the first cylindrical member 20 engages the palm of the user thereby ergonomically fitting the present invention 10 to the hand of the user.

A third cylindrical member 32 may, if desired, be formed or connected onto the elongated member 11. The third cylindrical member 32 has an interior surface formed about a cavity or aperture 34. If desired, the third cylindrical member 32 may traverse the thickness or width of the elongated member 11. The third cylindrical member 32 may, if desired, be located anywhere on the present invention 10. Preferably, the cylindrical member 32 is adjacently spaced from the forked wedge 12. The aperture 34 is sufficiently sized to receive the stem portion of the tack. For example, the aperture 34 is 0.05 inches. Once a tack stem is inserted into the aperture 34, the head of the tack may be partially rotated thereby aligning the centerline of the tack head with the centerline of the stem. This procedure straightens the tack and makes it usable.

Figure 4:
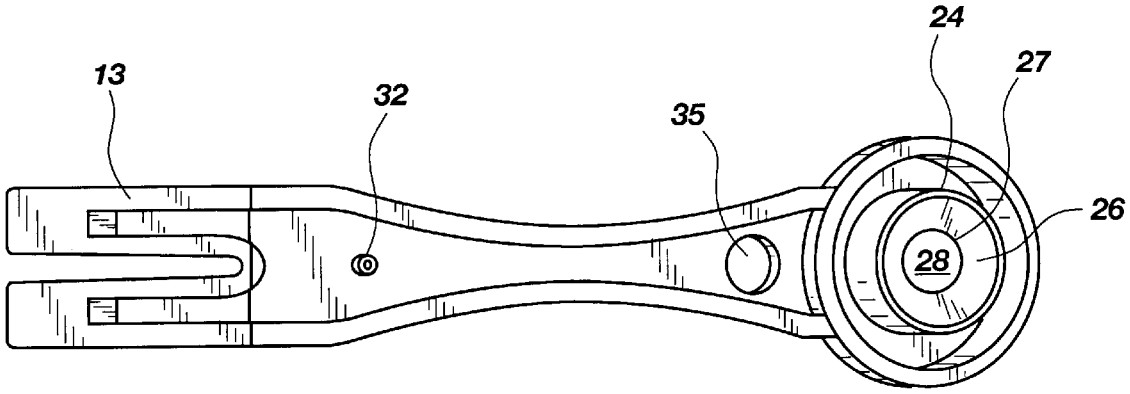
FIG. 4 illustrates a bottom view diagram of FIG. 1.

The present invention 10, FIG. 4 may, if desired, have a storage device aperture 35 located at any convenient place along the longitudinal length of the elongated member 11. Preferably, the storage aperture 35 is adjacently spaced from the first cylindrical member 20. The aperture 35 is sufficiently sized to receive a device enabling the present invention 10 to be stored. An example of such a device is a hook or peg with an end portion traversing the aperture 35 thereby detachably securing the present invention 10.

The best mode of operation of the present invention 10, FIG. 1 to remove a tack from a structure is for the user to grasp the present invention 10 between the thumb and forefinger of either hand. The thumb and forefinger are placed adjacent the base 17. The curved or convex surface 30 conforms to the natural curvature of the thumb for a right-handed user. The curved or convex surface 31 conforms to the natural curvature of the thumb for a left-handed user. The forefinger of either a right or a left-handed user partially wraps about the medial portion of the elongated member 11. The remaining fingers of the user's hand wrap about the present invention 10 in such a way as to force or press the convex portion 23 of the first cylindrical member 20 into the palm of the user. The convex portion 23 naturally forms to the curvature of the user's palm. The user's hand is now properly positioned about the present invention 10 thus ergonomically enabling the user to remove the tack from the structure.

Figure 2:
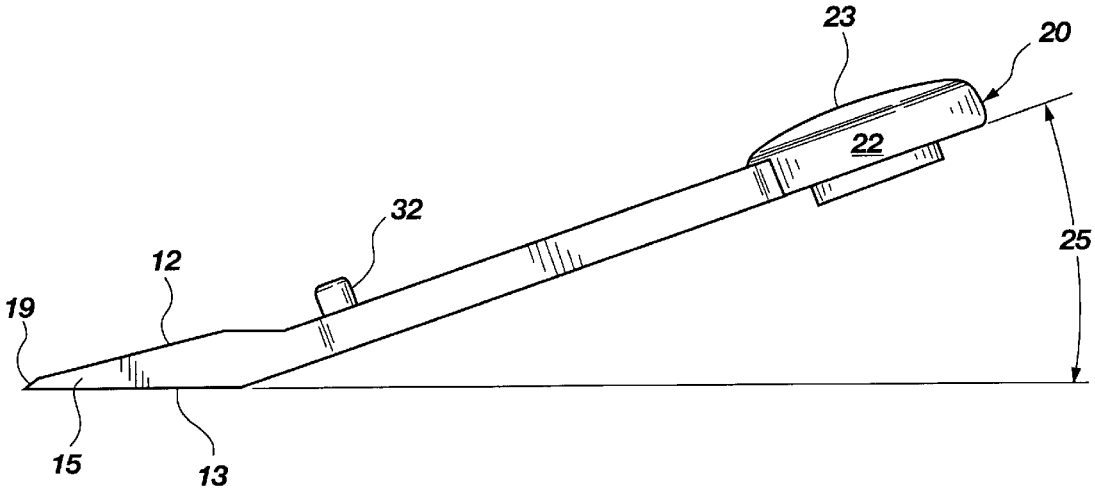
FIG. 2 illustrates a side view diagram of FIG. 1.
Figure 3:
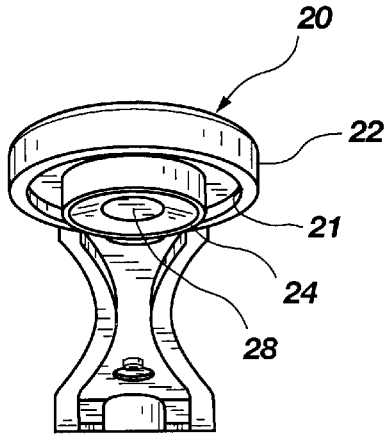
FIG. 3 illustrates an end view diagram of FIG. 1.

The procedure for removing the tack from the material and structure begins with the user positioning the flat portion 13, FIG. 2 of the forked wedge member 12 flat upon the material being retained to the structure by the tack. The present invention 10 is moved forward towards the tack. The prongs 14 and 15 of the forked wedge member 12 are positioned on either side of the tack head. The beveled portion or blades 18 and 19 of the prongs 14 and 15 respectively, engage the head of the tack. The blades 18 and 19 force the head of the tack upward by the continuous hand pressure of the user on the present invention 10. The stem of the tack moves upward as the V-portion 36 of the present invention 10 passes on either side of the tack stem. The wedge action of the forked wedge member 12 causes the tack to move upward during the continuous forward movement of the present invention 10. The tack is now removed from the structure.

If the tack becomes bent, misaligned during the extraction process, or misaligned for reasons not related to the present invention 10, FIG. 1 the tack may, if desired, be straightened. Misalignment is defined as the head of the tack at any angle other than 90° (degrees) referenced to the stem to the tack. The tack stem may, if desired, be inserted into the aperture 34 of the third cylindrical member 32. Pressure is applied to the head of the tack pushing the tack stem into the aperture 34 thus straightening the tack stem relative to the tack head.

A tack may, if desired, be inserted into material or structure using the present invention 10, FIG. 7. The first cylindrical member 20, properly grasped as discussed above, is positioned near the tack. The tack head, due to the magnetic forces of the metallic retaining mechanism 28, is attracted to the second cylindrical member 24. The tack head moves along the recessed portion 26 and engages the metallic retaining mechanism 28 thus properly positioning the tack for insertion into the material and structure. Once the tip of the stem engages the material, the user presses downward on the convex portion 23 with the palm of either hand thus firmly inserting the tack into the structure and joining the material to the structure.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together whereas a screw employs a helical surface, in the environment of fastening wooden parts, a nail and a screw may be equivalent structures.

I claim:

1. A user operable, hand gripable, and storable apparatus for inserting, straightening, and removing a tack, comprising:

a) a forked wedge member;

b) a first cylindrical member;

c) an elongated member connectively disposed between said forked wedge member and said first cylindrical member;

d) said forked wedge member angularly disposed to a longitudinal length of said elongated member;

e) said first cylindrical member having one end closed, said closed end forming a closed convex portion thereto;

f) said elongated member having an aperture disposed therein, said aperture sized to receive a device for storing the apparatus;

g) a second cylindrical member coaxially disposed within said first cylindrical member, said cylindrical member having a first end coupled to an inner surface of the closed convex portion, and extending towards an open end of said first cylindrical member; and h) a metallic retaining mechanism coaxially disposed within said second cylindrical member, said metallic retaining mechanism receiving the tack, the apparatus via the user's hand griping the apparatus operatively inserting the tack;

whereby the user's hand grips said elongated member pressing said convex portion into the palm, said forked wedge member via said user operatively extracting the tack.

2. A user operable, hand gripable apparatus as recited in claim 1 further comprising:

i) a tack straightening member adjacently spaced from and connectively disposed to said forked wedge member, said tack straightening member receiving the tack, the apparatus via the user's hand gripping the apparatus operatively straightening the tack.

3. A user operable, hand gripable apparatus recited in claim 2 wherein said tack straightening member being defined as a third cylindrically shaped tube with an inner surface and an outer surface, said inner surface surrounding a cavity sized to receive the stem portion of the tack.

4. A user operable, hand gripable apparatus recited in claim 3 wherein said elongated member having a top and bottom concave surface.

5. A user operable, hand gripable apparatus recited in claim 4 wherein, said forked wedge member being angularly disposed from said elongated member at an angle of about 5 degrees to about 45 degrees.

6. A user operable, hand gripable apparatus recited in claim 5 wherein said forked wedge member having a portion thereof beveled into a blade.

7. A use operable, hand gripable apparatus recited in claim 6 wherein said forked wedge member forming a V-shape.

8. A user operable, hand gripable apparatus recited in claim 7 wherein said forked wedge member being angularly disposed from said elongated member at an angle of 15° (degrees).

9. A method for a user operable, hand gripable, and storable apparatus for removing, inserting, and straightening a tack, the apparatus being defined as a forked wedge member, a first cylindrical member, and an elongated member connectively disposed there between, the forked wedge member being angularly disposed to the longitudinal length of the elongated member, the forked wedge member having a top and bottom surface, the first cylindrical member having a top and bottom surface, the first cylindrical member having one end closed forming a convex portion thereto, the first cylindrical member having an inner surface disposed about a second cylindrical member coaxially disposed thereto, the second cylindrical member having a first end coupled to an inner surface of the closed convex portion, and extending towards an open end of said first cylindrical member, the second cylindrical member having a metallic retaining mechanism connectively disposed therein, comprising the steps of:

1) grasping the elongated member with either hand by the user;

2) positioning the forked wedge member's bottom surface on the surface of the structure containing the tack;

3) sliding said bottom surface along the surface of the structure containing the tack;

4) engaging the tack head causing the tack head to move upwardly along the top surface of the forked wedge member;

thereby extracting the tack.

10. A method recited in claim 9 further comprising the steps of:

e) providing two structures in an overlaying relationship:

f) grasping the elongated member between the thumb and forefinger by the user, wrapping the remaining fingers about the elongated member pressing the convex portion of the first cylindrical member into the palm of the user's hand;

g) positioning the second cylindrical member in proximity to the tack to be inserted into said structures;

h) seburing the head portion of the tack by the metallic retaining mechanism;

i) positioning said secured tack relative to said structures; and j) pressing downward with the palm portion of the user's hand thereby inserting the tack and connectively joining the two overlaying structures.

* * * * *